US008857523B2

(12) United States Patent
Lau

(10) Patent No.: US 8,857,523 B2
(45) Date of Patent: Oct. 14, 2014

(54) DOWNHOLE MULTIPLE WELL

(75) Inventor: Hon Chung Lau, Bellaire, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/881,630

(22) PCT Filed: Oct. 26, 2011

(86) PCT No.: PCT/US2011/057854
§ 371 (c)(1),
(2), (4) Date: Apr. 25, 2013

(87) PCT Pub. No.: WO2012/058288
PCT Pub. Date: May 3, 2012

(65) Prior Publication Data

US 2013/0240215 A1 Sep. 19, 2013

Related U.S. Application Data

(60) Provisional application No. 61/407,084, filed on Oct. 27, 2010.

(51) Int. Cl.

| | |
|---|---|
| ***E21B 17/18*** | (2006.01) |
| ***E21B 33/047*** | (2006.01) |
| ***E21B 43/01*** | (2006.01) |
| ***E21B 19/00*** | (2006.01) |
| ***E21B 41/00*** | (2006.01) |

(52) U.S. Cl.
CPC ..... *E21B 43/01* (2013.01); *E21B 17/18* (2013.01); *E21B 33/047* (2013.01); *E21B 19/002* (2013.01); *E21B 41/0035* (2013.01)
USPC ..... 166/366; 166/352; 166/367; 166/368; 405/224.2

(58) Field of Classification Search
CPC ..... E21B 17/18; E21B 19/002; E21B 33/047; E21B 41/0035; E21B 43/01; E21B 17/01
USPC ..... 166/366, 350–352, 367, 368, 378–380; 138/111, 115; 285/123.1, 123.2, 124.1; 405/224.2
See application file for complete search history.

(56) References Cited

U.S. PATENT DOCUMENTS

| | | | | | |
|---|---|---|---|---|---|
| 1,900,163 | A | * | 3/1933 | Drexler et al. | 175/9 |
| 2,492,079 | A | * | 12/1949 | Wiley | 166/117.5 |
| 3,409,084 | A | * | 11/1968 | Lawson, Jr. et al. | 166/86.1 |
| 3,481,395 | A | * | 12/1969 | Sizer et al. | 166/363 |
| 3,601,196 | A | * | 8/1971 | Childers et al. | 166/297 |
| 4,068,729 | A | * | 1/1978 | Peevey | 175/8 |
| 4,253,525 | A | | 3/1981 | Young | 166/336 |
| 4,573,541 | A | * | 3/1986 | Josse et al. | 175/78 |

(Continued)

OTHER PUBLICATIONS

PCT International Search Report, Application No. PCT/US2011/057854 dated May 17, 2012.

*Primary Examiner* — Matthew Buck

(57) ABSTRACT

An offshore oil production system, comprising a structure in a body of water, having a portion extending above a surface of the body of water; a wellhead located at a boom of the body of water; a riser extending from the wellhead to the portion extending above the surface; a primary wellbore extending into a subsea formation beneath the body of water; and at least two secondary wellbores extending further into the subsea formation beneath the body of water and beneath the primary wellbore.

8 Claims, 3 Drawing Sheets

(56) References Cited

U.S. PATENT DOCUMENTS

| | | | | | |
|---|---|---|---|---|---|
| 5,330,007 | A * | 7/1994 | Collins et al. | 166/313 |
| 5,458,199 | A * | 10/1995 | Collins et al. | 166/313 |
| 5,533,574 | A * | 7/1996 | Gonzalez | 166/358 |
| 5,560,435 | A * | 10/1996 | Sharp | 175/5 |
| 5,775,420 | A | 7/1998 | Mitchell et al. | 166/85.4 |
| 5,865,260 | A * | 2/1999 | Jackson et al. | 175/5 |
| 6,079,495 | A * | 6/2000 | Ohmer | 166/313 |
| 6,145,596 | A | 11/2000 | Dallas | 166/379 |
| 6,170,571 | B1 * | 1/2001 | Ohmer | 166/65.1 |
| 6,182,760 | B1 * | 2/2001 | Phelps | 166/313 |
| 6,247,532 | B1 * | 6/2001 | Ohmer | 166/50 |
| 6,279,658 | B1 * | 8/2001 | Donovan et al. | 166/313 |
| 6,283,216 | B1 * | 9/2001 | Ohmer | 166/313 |
| 6,336,421 | B1 * | 1/2002 | Fitzgerald et al. | 114/264 |
| 6,431,283 | B1 * | 8/2002 | Dale | 166/341 |
| 6,491,101 | B2 * | 12/2002 | Ohmer | 166/313 |
| 6,732,801 | B2 * | 5/2004 | Ohmer et al. | 166/313 |
| 7,066,267 | B2 * | 6/2006 | Hall | 166/313 |
| 7,264,067 | B2 * | 9/2007 | Glaser et al. | 175/61 |
| 2001/0013414 | A1 * | 8/2001 | Fitzgerald et al. | 166/366 |
| 2010/0126729 | A1 * | 5/2010 | Tunget | 166/313 |

* cited by examiner

DOWNHOLE MULTIPLE WELL

PRIORITY CLAIM

The present application claims priority from PCT/US2011/057854, filed Oct. 26, 2011, which claims priority from U.S. provisional application 61/407,084, filed Oct. 27, 2010, which is incorporated herein by reference.

BACKGROUND OF INVENTION

1. Field of the Invention

The present invention is directed to multiple wells located within a single offshore riser used in deepwater.

2. Background Art

U.S. Patent Application Publication 2010/0126729 discloses systems and methods usable to operate on a plurality of wells through a single main bore. One or more chamber junctions are provided in fluid communication with one or more conduits within the single main bore. Each chamber junction includes a first orifice communicating with the surface through the main bore, and one or more additional orifices in fluid communication with individual wells of the plurality of wells. Through the chamber junctions, each of the wells can be individually or simultaneously accessed. A bore selection tool having an upper opening and at least one lower opening can be inserted into the chamber junction such that the one or more lower openings align with orifices in the chamber junction, enabling selected individual or multiple wells to be accessed through the bore selection tool while other wells are isolated from the chamber junction. U.S. Patent Application Publication 2010/0126729 is herein incorporated by reference in its entirety.

U.S. Pat. No. 5,775,420 discloses a dual completion for gas wells including a dual base with a primary hanger incorporated in the base. Primary and secondary coiled tubing strings extend through the base at a downwardly converging angle of 2 degree or less. The dual base is mounted on an annular blowout preventer. At the top of the annular blowout preventer is a tubing centralizer that aligns the two tubing strings parallel to one another. The blowout preventer has two side ports below the bladder allowing the operator to produce gas from the annulus, to flare gas to atmosphere or to pump in kill fluid in the event of an emergency. The alignment of the tubing strings allows production recorders to be run in either string. U.S. Pat. No. 5,775,420 is herein incorporated by reference in its entirety.

U.S. Pat. No. 3,601,196 discloses a method for perforating in a dual, parallel pipe string tubingless well. A crossover passage or port connects these pipe strings. Each pipe string is provided with a landing nipple at about the same depth below the crossover port. A radioactive source tool, which includes a radioactive pill for transmitting radiation in angular directions and a seating member for seating the radioactive source tool in the landing nipple arranged in one of the pipe strings, is pumped through the one pipe string until the seating member is landed in the landing nipple. The radioactive pill is suspended from the seating member a predetermined distance which is approximately the level at which it is desired to perforate. A perforating assembly, which includes a directional perforating gun, a directional radiation detector, a radioactivity-sensitive gun-firing mechanism including a source of electrical power for causing actuation of the perforating gun, a rotation device for causing the perforating gun to rotate, a seating member for seating the perforating assembly in the landing nipple arranged in the other pipe string, and a locomotive device for moving the perforating assembly through the other pipe string, is then pumped through the other pipe string until the seating member lands in the landing nipple. The detector of the perforating assembly is suspended a predetermined distance from the seating member so that it is positioned at the same level as the radioactive pill in the adjacent pipe string. The firing mechanism utilizes a switch which is actuated when the radioactive count detected by the radiation detector reaches a predetermined level. The directional gun is aimed so as to fire in a predetermined angular direction when the directional detector is facing the radioactive pill. The perforating assembly is rotated by circulating fluid in the pipe strings. After the perforating gun has fired, the perforating assembly is removed from the other pipe string. The radioactive source tool is then removed from the one pipe string. The perforating gun may be reloaded and the perforating procedure repeated at a different level in the well bore after repositioning the radioactive source tool and perforating assembly. U.S. Pat. No. 3,601,196 is herein incorporated by reference in its entirety.

U.S. Pat. No. 7,066,267 discloses a splitter assembly is positioned downhole within a conductor for separating two or more tubular strings placed within the conductor. A splitter housing may include a first bore and a second bore for separating a first well from a second well, and a plug positioned in one of the bores including a top face sloping downwardly toward the other bore. One or more guide plates secured to the splitter housing and positioned above the plug guide a bit or other tool toward one of the first bore and the second bore. The splitter housing may be positioned along the conductor after the conductor is jetted in place. According to the method, the plug in one of the bores is retrieved after a casing is run in one well, so that the second bit and the second casing will pass through the bore which previously included the plug. U.S. Pat. No. 7,066,267 is herein incorporated by reference in its entirety.

SUMMARY OF INVENTION

One aspect of the invention provides an offshore oil production system, comprising a structure in a body of water, having a portion extending above a surface of the body of water; a wellhead located at a bottom of the body of water; a riser extending from the wellhead to the portion extending above the surface; a primary wellbore extending into a subsea formation beneath the body of water; and at least two secondary wellbores extending further into the subsea formation beneath the body of water and beneath the primary wellbore.

DETAILED DESCRIPTION

In one aspect, embodiments disclosed herein relate to a riser sharing wellhead system which allows two or more independent wells to share on common deepwater riser. More specifically, embodiments disclosed herein relate to a riser sharing wellhead system that may be used in deepwater applications.

Figure 1:
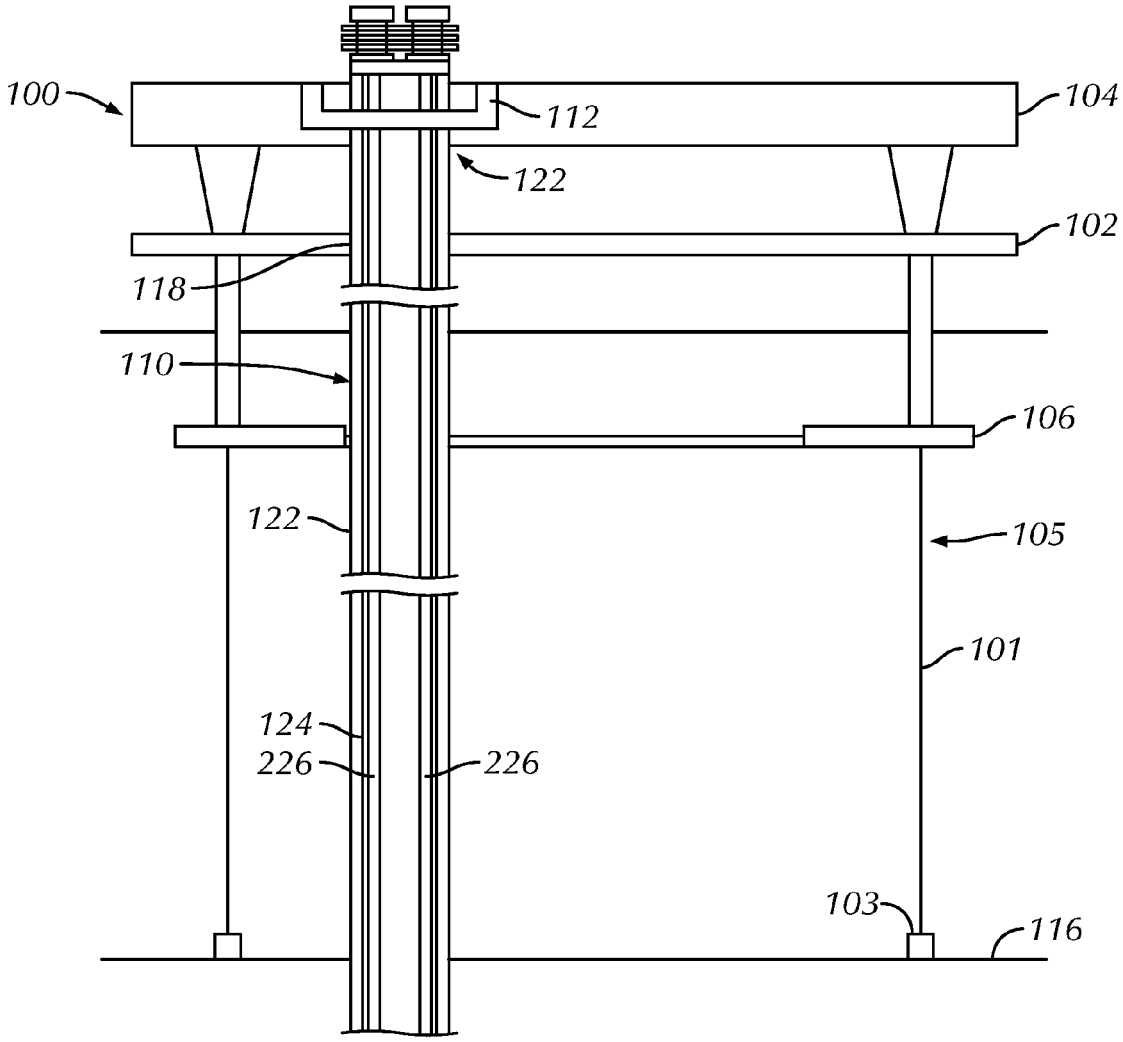
FIG. 1 shows a schematic view of a floating offshore structure and deepwater wellbore in accordance with the present disclosure.

FIG. 1:

Referring to FIG. 1, a schematic view of a floating offshore structure and a deepwater wellbore in accordance with the present disclosure is shown. Specifically, in FIG. 1, a tension-leg platform ("TLP") 100 is shown. Tension-leg platforms ("TLP") may be used in deepwater environments and may include a buoyant platform 106 tethered to a mudline 116 using a mooring system 105. Typically, mooring system 105 includes tension legs 101, or tendons, connecting a buoyant platform 106 to one or more foundations 103 driven into mudline 116. Because tension legs 101 are often made from materials having low axial elongation and compression, such as, for example, steel pipe, tension legs 101 may dampen vertical movement of buoyant platform 106 with respect to mudline 116, while permitting some horizontal movement. The restriction of vertical movement of buoyant platform 106 may prevent risers and tubing from experiencing high tensile or compressive forces, while the horizontal flexibility allows buoyant platform 106 to move in response to waves. In certain TLPs, between 8 and 32 tension legs 101 may be used. Each tension leg 101 may have an outer diameter of approximately 2 to 3 feet, and a wall thickness of approximately 3 inches. Those of ordinary skill in the art will appreciate that the number and dimension of tension legs 101 used in mooring system 105 may vary depending on the depth of the water, and the size of TLP 100.

TLP 100 may include a plurality of decks such as, for example, a main deck 102 and a weather deck 104. Main deck 102 and weather deck 104 may accommodate various pieces of equipment required for drilling and production operations. Additionally, main deck 102 and/or weather deck 104 may include a plurality of slots 118, and each of a plurality of risers 110 may extend through slot 118. Risers 110 in accordance with the present disclosure may include single-bore risers or dual-bore risers. Riser 110 shown in FIG. 1 is a dual-bore riser because it includes an outer riser 122 and at least one inner riser 124. Dual-bore risers may withstand higher static pressures than single-bore risers, and thus, dual-bore risers may be preferable in deepwater environments.

Each of a plurality of risers 110 may be coupled to weather deck 104, or main deck 102, using a riser tensioner 112. Riser tensioner 112 may be mounted between the TLP structure 100 and riser 110, and may be used to apply a constant upward axial force to riser 110, regardless of any upward or downward motion of buoyant platform 106. Those of ordinary skill in the art will appreciate that riser tensioner 112 may use, for example, hydraulic piston cylinders or biased springs which may provide upward axial force on riser 110. Because the upward axial force applied by riser tensioner 112 is independent from vertical or horizontal movements of TLP 100, tensioner 112 may, for example, prevent riser 110 from buckling if the TLP moves vertically downward.

Although a TLP is described in detail above with reference to FIG. 1, other floating structures may be used to support upper ends 122 of risers 110. Those of ordinary skill in the art will appreciate that alternative floating structures such as, for example, spar platforms, semisubs, drillships, unmanned installations, and conductor support systems, are within the scope of the present disclosure.

Figure 2:
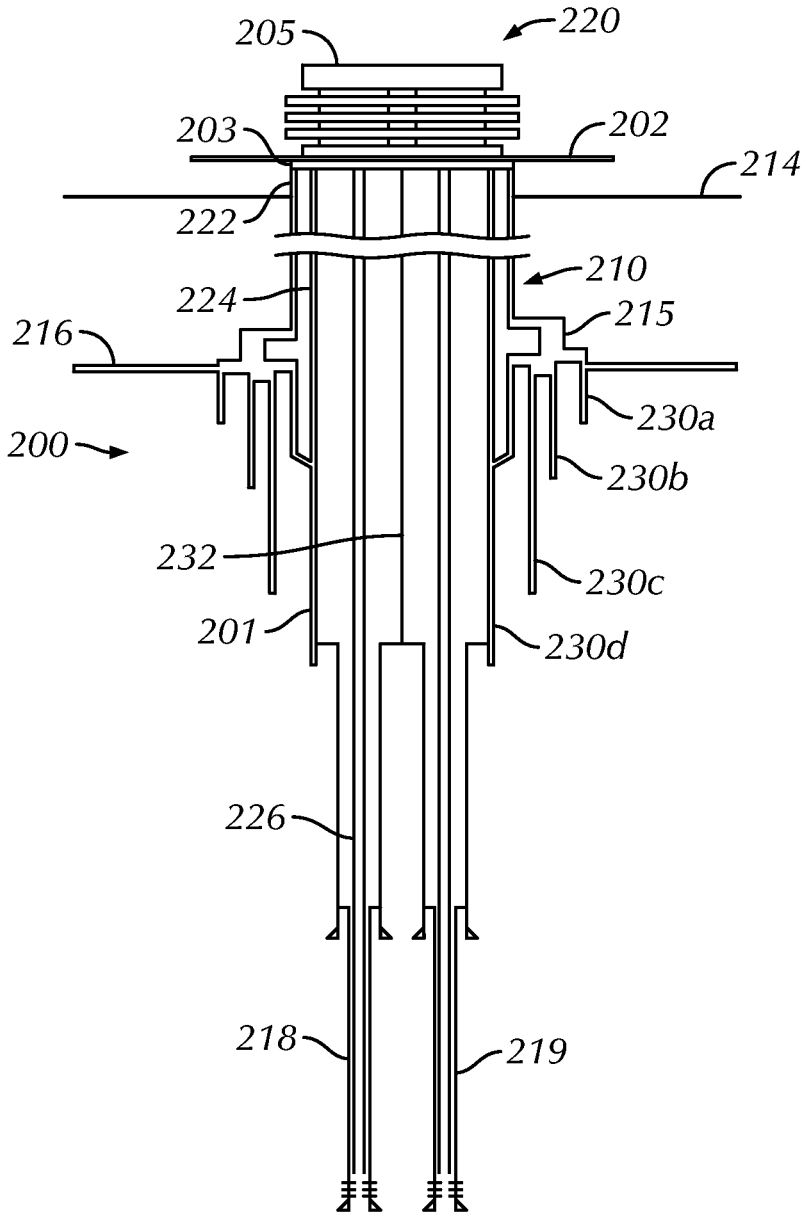
FIG. 2 shows a schematic view of a floating offshore structure and deepwater wellbore in accordance with the present disclosure.

FIG. 2:

Referring to FIG. 2, a schematic view of a floating offshore structure and a deepwater wellbore 200 in accordance with the present disclosure is shown. A riser sharing wellhead assembly 220 is shown disposed on a deck 202 of a floating structure (not independently illustrated). Riser sharing wellhead assembly 220 may include a riser sharing wellhead plate 203 having two or more surface trees 205 disposed thereon. Surface trees 205 may include a plurality of valves, spools, and fittings used to control fluid flow through riser sharing wellhead assembly 220.

A riser assembly 210 may extend downwardly from riser sharing wellhead assembly 220, past water line 214, and may sealingly engage subsea wellhead 215, disposed at mud line 216. In certain embodiments, riser assembly 210 may be a dual-bore riser having an outer riser 222 disposed concentrically around an inner riser 224. A dual-bore riser may have higher pressure ratings than a single-bore riser, and may be preferable for deepwater environments having high hydrostatic pressures. A series of concentric casing segments 230*a-d* may be disposed below subsea wellhead 215 to line a primary wellbore 201. One of ordinary skill in the art will appreciate that any number and size of casing segments 230 may be used, generally beginning with a relatively short section of casing having a large diameter, with each subsequent section of casing increasing in length, and decreasing in diameter, as a primary wellbore 201 is drilled deeper. Primary wellbore 201 is a single wellbore having an initial diameter corresponding to subsea wellhead 215. The depth to which primary wellbore 201 is drilled may be determined by factors such as, for example, location of the targeted reservoir, and composition of the drilled formation.

After a desired primary wellbore depth is reached, two or more secondary wellbores 218, 219 may be drilled from a circumferential or bottom surface of primary wellbore 201. It may be desirable to drill secondary wellbores 218, 219 from the bottom surface of primary wellbore 201 because the circumferential surface may be reinforced with casing segments. Drilling multiple secondary wellbores 218, 219 from primary wellbore 201 may allow for fluid to be produced simultaneously from multiple areas of the reservoir using a single riser assembly connected to a single slot on deck 202.

Figure 3C:
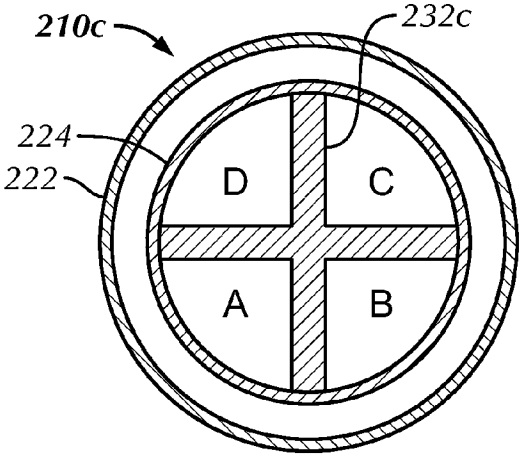
FIGS. 3*a*, 3*b*, and 3*c* show top cross-sectional views of riser assemblies in accordance with the present disclosure.
Figure 3B:
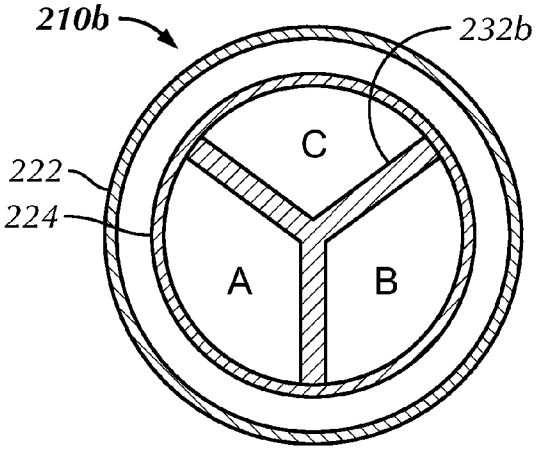
Figure 3A:
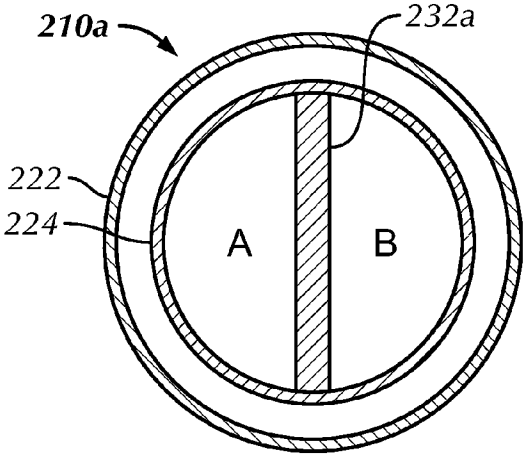

FIGS. 3A, 3B, & 3C:

Referring briefly to FIGS. 3*a*, 3*b*, and 3*c*, top views of riser assemblies 210*a*, 210*b*, and 210*c* are shown, respectively.

Referring to FIG. 3*a*, a divider 232*a* is shown disposed in riser assembly 210*a*. Divider 232*a* is planar and divides inner riser 224 of riser assembly 210*a* into two distinct regions A, B.

Alternative dividers 232*b* and 232*c* are shown in FIGS. 3*b* and 3*c*, respectively. Divider 232*b* separates inner riser 224 of riser assembly 210*b* into three regions A, B, and C, while divider 232*c* separates inner riser 224 of riser assembly 210*c* into four regions, A, B, C, and D.

Dividers 232*a*, 232*b*, and 232*c* may be secured within inner riser 224 using any means known in the art. For example, dividers 232*a*, 232*b*, and 232*c* may be integrally formed with inner riser 224, or may be separately installed using friction fitting, welding, adhesives, or mechanical fasteners, such as bolts and rivets. In embodiments using a single-bore riser rather than a dual-bore riser, dividers 232*a*, 232*b*, and 232*c* may be installed such that the volume within by the single-bore riser is divided into two, three, or four distinct areas, respectively.

Referring to FIGS. 2 and 3*a-c* together, dividers 232*a*, 232*b*, and 232*c* may allow for a drill string to be run into a specific area of primary wellbore 201 by preventing the drill string from crossing over into other areas of primary wellbore 201. Moreover, during production, divider 232 may serve to keep production tubing for each of the secondary wellbores 218, 219 separate, thereby preventing the production tubing from being damaged. For simplicity, primary wellbore 201 will be considered to have a planar divider 232 separating the wellbore 201 into two regions, A, B; however, as discussed above, alternate dividers may be used to divide primary wellbore 201 into more than two spaces.

Once divider 232 is in place, a first secondary wellbore 218 and a second secondary wellbore 219 may be drilled from regions A and B, respectively, of primary wellbore 201. After first and second secondary wellbores 218, 219 are drilled to a desired depth, completions operations may begin. Production tubing 226 may be installed in each of the secondary wellbores 218, 219. Production tubing 226 may extend upward from each of the secondary wellbores 218, 219 to riser sharing wellhead assembly 220, where each line of production tubing 226 may connect to one of a plurality of surface trees 205. In such a configuration, fluid flow from each of the plurality of secondary wellbores 218, 219 may be controlled separately. While secondary wellbores 218, 219 are shown in FIG. 2 to be vertical wellbores, those of ordinary skill in the art will appreciate that directional drilling may be used to drill non-vertical wellbores. The trajectory and depth of the secondary wells 218, 219 may be determined based on the location of the targeted reservoir, and secondary wells 218, 219 may have different trajectories and/or depths.

Existing offshore floating structures having a single wellbore per slot on the floating structure may be retrofitted to include the riser sharing well described above. In one embodiment, all production tubing may be pulled out of the existing well, and a divider 232 may be installed in riser assembly. One or more secondary wellbores may be drilled from the existing wellbore, and new production tubing may be installed in each of the drilled secondary wellbores, thereby allowing production from each of the secondary wellbores. To control the flow of produced fluid from each of the multiple secondary wellbores, a riser sharing wellhead assembly may be installed on the floating structure, the riser sharing wellhead assembly having one surface tree per line of production tubing.

Referring to FIGS. 1 and 2 together, riser sharing wellhead assembly 220 occupies only one slot 118 on a floating offshore structure. It is advantageous to reduce the size of a floating offshore structure to minimize manufacturing and installation costs; however, it is also desirable to maximize the amount of fluid produced from each floating offshore structure. While adding more slots to a floating offshore structure may allow the structure to accommodate an increased number of wells, additional slots may require that the size of floating offshore structure be increased. The present application advantageously allows for production from an increased number of wells without increasing the size of the floating offshore structure.

As discussed above with respect to FIG. 2, riser sharing wellhead assembly 220 may connect to at least two secondary wellbores 218, 219, and as such, a floating offshore structure in accordance with the present disclosure may produce fluid from approximately two to four times more wells than a floating offshore structure of the same size which has a single wellhead per slot 118 connecting to only one wellbore. Advantageously, the amount of fluid produced by a floating offshore structure in accordance with the present disclosure may be increased, which may correspond to an increased production rate and/or a reduced size offshore structure. Further, because of the increased number of wells capable of producing fluid, a reservoir may be drained more quickly, thereby decreasing the required design life of the floating offshore structure. As a result, maintenance costs of the structure may be reduced. Additionally, in certain embodiments, existing offshore structures may be retrofitted to include the riser sharing wellhead system described herein. Retrofitting an existing floating offshore structure may extend the life of the structure and may increase the fluid producing capacity of the structure. Advantageously, in certain embodiments, the system of the present disclosure may allow for marginal reserves, which normally do not warrant a standalone well, to be tapped and drained from one leg of a riser sharing well. This may improve the ultimate recovery of the reservoir.

Illustrative Embodiments

In one embodiment, there is disclosed an offshore oil production system, comprising a structure in a body of water, having a portion extending above a surface of the body of water; a wellhead located at a bottom of the body of water; a riser extending from the wellhead to the portion extending above the surface; a primary wellbore extending into a subsea formation beneath the body of water; and at least two secondary wellbores extending further into the subsea formation beneath the body of water and beneath the primary wellbore. In some embodiments, the system also includes a production tubing within each of the secondary wellbores. In some embodiments, the production tubing extends from the secondary wellbore to the portion extending above the surface. In some embodiments, the riser comprises at least one divider to separate the riser into at least two regions. In some embodiments, each of the regions comprises a production tubing extending from the secondary wellbore. In some embodiments, the primary wellbore further comprises a casing string. In some embodiments, each of the secondary wellbores further comprises a casing string. In some embodiments, a top end of the riser is connected to a wellhead on the structure. In some embodiments, the wellhead on the structure comprises at least two surface trees. In some embodiments, the riser comprises at least three regions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. An offshore oil production system, comprising:

a structure in a body of water, having a portion extending above a surface of the body of water;

a first wellhead located at a bottom of the body of water;

a second wellhead located on the portion of the structure extending above the surface of the body of water, wherein the second wellhead comprises a well head plate having a first surface tree and a second surface tree disposed thereon;

a dual-bore riser extending from the first wellhead to the second wellhead, wherein the dual-bore riser comprises an outer riser disposed concentrically around an inner riser;

a primary wellbore extending into a subsea formation beneath the body of water; and a first secondary wellbore and a second secondary well bore each extending further into the subsea formation beneath the body of water and beneath the primary wellbore.

2. The system of claim 1, further comprising a first production tubing within the first secondary wellbore and a second production tubing within the second secondary wellbore.

3. The system of claim 2, wherein the first production tubing extends from the first secondary wellbore to the first surface tree and the second production tubing each extends from the second secondary wellbore to the second surface.

4. The system of claim 3, wherein the inner riser comprises at least one divider to separate the riser into a first region and a second region.

5. The system of claim 4, wherein a portion of the first production tubing is disposed within the first region and a portion of the second production tubing is disposed within the second region.

6. The system of claim 1, wherein the primary wellbore further comprises a casing string.

7. The system of claim 1, wherein the first secondary wellbore comprise a casing string and the second secondary wellbore comprises a casing string.

8. The system of claim 1, wherein the inner riser comprises a first region, a second region, and a third region.

* * * * *